United States Patent [19]

Dickakian

[11] Patent Number: 4,518,483

[45] Date of Patent: May 21, 1985

[54] AROMATIC PITCH FROM ASPHALTENE FRACTIONS

[75] Inventor: Ghazi Dickakian, Greenville, S.C.

[73] Assignee: E. I. Du Pont de Nemours and Company, Wilmington, Del.

[21] Appl. No.: 508,183

[22] Filed: Jun. 27, 1983

[51] Int. Cl.[3] ..... C10C 1/20; C10C 1/18; C10C 3/08

[52] U.S. Cl. ..... 208/44; 208/22; 208/39

[58] Field of Search ..... 208/44, 22, 39

[56] References Cited

U.S. PATENT DOCUMENTS

| | | | |
|---|---|---|---|
| 3,373,101 | 3/1968 | Falkins et al. | 208/44 |
| 3,767,741 | 10/1973 | Toyoguchi et al. | 423/447 |
| 3,801,342 | 4/1974 | Berber et al. | 208/22 |

FOREIGN PATENT DOCUMENTS

| | | | |
|---|---|---|---|
| 627305 | 9/1961 | Canada | 208/44 |
| 10826 | 1/1976 | Japan | 208/44 |
| 899598 | 6/1962 | United Kingdom | 208/44 |

*Primary Examiner*—Delbert E. Gantz
*Assistant Examiner*—Helane M. Myers

[57] ABSTRACT

A pitch suitable for carbon artifact manufacture, such as the manufacture of carbon fibers, is obtained by heat-soaking an asphaltene fraction of a heavy aromatic feedstock at a temperature of about 380°-440° C. for about 1-500 minutes.

8 Claims, 2 Drawing Figures

Differential Thermo Gravimetric Analysis (DTG in Nitrogen) Of Steam Cracker Tar, Asphaltene and Asphaltene-Free Oil Molecular Weight Distribution of Asphaltenes Present in Petroleum Binders GPC, $C_3H_3Cl_3$ Solvent, 93°C

AROMATIC PITCH FROM ASPHALTENE FRACTIONS

FIELD OF THE INVENTION

The present invention relates to a process for preparing a pitch which can be used in carbon artifact manufacture, such as carbon fiber production, and to the pitch thus produced.

BACKGROUND OF THE INVENTION

As is well-known, the catalytic conversion of virgin gas oils containing aromatic, naphthenic and paraffinic molecules results in the formation of a variety of distillates that have ever-increasing utility and importance in the petrochemical industry. One potential use for such distillates is in the manufacture of carbon artifacts. As is well-known, carbon artifacts have been made by pyrolyzing a wide variety of organic materials. Indeed, one carbon artifact of particularly important commercial interest is carbon fiber and particular reference is made herein to carbon fiber technology. Nevertheless, it should be appreciated that this invention has applicability to carbon artifacts in a general sense, with emphasis upon the production on shaped carbon articles in the form of filaments, yarns, films, ribbons, sheets, etc.

The use of carbon fibers for reinforcing plastic and metal matrices has gained considerable commercial acceptance. The exceptional properties of these reinforcing composite materials, such as their high strength to weight ratio, clearly offset their high preparation costs. It is generally accepted that large scale use of carbon fibers as reinforcing material would gain even greater acceptance in the marketplace, if the cost of the fibers could be substantially reduced. Thus, the formation of carbon fibers from relatively inexpensive carbonaceous pitches has received considerable attention in recent years.

Many materials containing polycondensed aromatics can be converted at early stages of carbonization to a structurally ordered optically anisotropic spherical liquid crystal called mesophase. The presence of this ordered structure prior to carbonization is considered to be fundamental in obtaining a high quality carbon fiber. Thus, one of the first requirements of a feedstock material suitable for carbon fiber production, is its ability to be converted to a highly optically anisotropic material.

In addition, suitable feedstocks for carbon artifact manufacture, and in particular carbon fiber manufacture, should have relatively low softening points and sufficient viscosity suitable for shaping and spinning into desirable articles and fibers.

Unfortunately, many carbonaceous pitches have relatively high softening points. Indeed, incipient coking frequently occurs in such materials at temperatures where they have sufficient viscosity for spinning. The presence of coke, infusible materials, and/or high softening point components, are detrimental to the fiber-making process.

Another important characteristic of the feedstock for carbon artifact manufacutre is its rate of conversion to a suitable optically anisotropic material.

U.S. Pat. No. 4,208,267 teaches that typical grafitized carbonaceous pitches contain a separable fraction which has important physical and chemical properties, exhibiting a softening range viscosity suitable for spinning and having the ability to be converted rapidly to an optically anisotropic, deformable, liquid crystalline material structure. Unfortunately, the amount of separable fraction present in well-known commercially available petroleum pitches, such as Ashland 240 and Ashland 260, to mention a few, is exceedingly low. For example, no more than about 10% of the Ashland 240 pitch constitutes a separable fraction capable of being thermally converted to a deformable anisotropic phase. U.S. Pat. No. 4,184,942 teaches that the amount of the aforementioned fraction can be increased by heat soaking the feedstock at temperatures in the 350°–450° C. until sphericals visible under polarized light begin to appear.

In U.S. Pat. No. 4,271,006, a process has been disclosed for converting catalytic cracker bottoms of a feedstock suitable in carbon artifact manufacture which requires stripping the cat cracker bottoms of fractions boiling below 400° C. and thereafter heat soaking followed by vacuum stripping to provide a carbonaceous aromatic pitch.

The heavy aromatic residues used in carbon artifact manufacture are produced as by-products from the thermal or catalytic cracking of petroleum and coal feedstocks. Examples are the cat cracker bottom obtained from the catalytic cracking of petroleum distillate, the steam cracker tar produced from the steam cracking of naphtha or gas oil, and the coal tars from coal carbonization, liquefaction, or gasification. These heavy aromatic residues vary in their chemical structure, molecular weight, aromatic ring distributions and thermal and coking characteristics as a result of differences in the feed, the process and the conditions used for processing the feed. A summary of characteristics of various heavy aromatic residues is set forth in Table I:

TABLE I

THE CHEMICAL CHARACTERISTICS OF HEAVY AROMATIC FEEDSTOCK

| HEAVY AROMATIC FEEDSTOCK | CAT CRACKER BOTTOM (CCB) | CAT CRACKER BOTTOM (CCB) | STEAM CRACKER TAR (SCT) | STEAM CRACKER TAR (SCT) | COAL TAR (CT) | COAL TAR (CT) | FLUID CAT CRACKER BOTTOM (FCCB) |
|---|---|---|---|---|---|---|---|
| PROCESS OF PRODUCTION | LOW SEVERITY CATALYST CRACKING | HIGH SEVERITY CATALYST CRACKING | STEAM CRACKING OF GAS OIL | STEAM CRACKING (NAPHTHA) | HIGH TEMPERATURE COAL CARBONIZATION | COAL LIQUEFACTION | FLUID CATALYTIC CRACKING |
| AROMATICITY (AROMATIC CARBON, ATOM %) (CARBON-CMR) | 33 | 65 | 70 | 72 | 90 | 57 | 33 |
| AROMATIC PROTONS (%) (PROTON-NMR) | 13 | 27 | 44 | 46 | 55 | 21 | 10 |
| COKING YIELD AT (550° C.) (%) | 6 | 10 | 20 | 8 | 6 | 15 | 7 |

TABLE I-continued

| THE CHEMICAL CHARACTERISTICS OF HEAVY AROMATIC FEEDSTOCK | | | | | | | |
|---|---|---|---|---|---|---|---|
| (5MTTP METHOD PI-10-67) | | | | | | | |
| AVE. MOL. WEIGHT (GPC METHOD) | 240 | 260 | 300 | 310 | 220 | 210 | 370 |
| ASPHALTENE (%) (n-HEPTANE INSOLUBLES) | 1 | 1–5 | 20–30 | 5–15 | 2 | 10 | 1 |
| C/H ATOMIC RATIO | 0.80 | 0.96 | 1.05 | 1.02 | 1.50 | 1.30 | 0.81 |

The heavy aromatic residues are composed of two components: (1) a low molecular weight oil fraction which can be distilled; and (2) an undistillable fraction of high molecular weight. The high molecular weight fraction is insoluble in paraffinic solvents such as n-heptane, iso-octane, petroleum ether, etc. and is termed "asphaltene". Table II below gives the average molecular weight, carbon/hydrogen atomic ratio and the coking characteristics of the oil and asphaltene fractions of three heavy aromatic residue feedstocks.

The oil and the asphaltene parts vary significantly in their molecular weights, the oil being of a low average molecular weight of 200–250 while the asphaltene has a very broad and much higher molecular weight ($\overline{M}n=600-1500$). For example, the molecular weight distribution of a steam cracker tar asphaltene is illustrated in FIG. 2.

Table 3 below, illustrates the differences in chemical, physical, coking, thermal and molecular weight characteristics of the asphaltene and the deasphaltenated oils of a steam cracker tar pitch, a coal tar pitch and a petroleum pitch.

TABLE 2

| CHARACTERISTICS OF ASPHALTENES AND OIL FRACTIONS IN HEAVY AROMATIC FEEDSTOCK | | | | | | | | | |
|---|---|---|---|---|---|---|---|---|---|
| | STEAM CRACKER TAR | | | CAT CRACKER TAR | | | COAL TAR | | |
| CHARACTERISTICS | TOTAL FEED | ASPHAL-TENE | OIL | TOTAL FEED | ASPHAL-TENE | OIL | TOTAL FEED | ASPHAL-TENE | OIL |
| CARBON/HYDROGEN ATOMIC RATIO | 1.05 | 1.05 | 1.05 | 1.05 | 1.26 | 0.94 | 1.33 | 1.41 | 1.27 |
| AVERAGE MOL. WEIGHT (Mn) | 280 | 700 | 180 | 180 | 650 | 180 | 185 | 220 | 150 |
| COKING VALUE (WT %) at 550° C. | 20 | 45 | 7 | 7 | 65 | 4 | 6 | 13 | NIL |

In addition to varying in chemical structure, molecular weight and coking characteristics, the oil and asphaltene vary significantly in their boiling and thermal characteristics. FIG. 1 illustrates the differential thermogravimetric analysis of a steam cracker tar heavy aromatic residue and its oil and asphaltene fractions. As can be seen, the two fractions have different boiling and decomposition ranges.

TABLE 3

| CHARACTERISTICS OF SCT-PITCH, COAL TAR PITCH, PETROLEUM PITCH, THEIR $C_7$ ASPHALTENES AND DEASPHALTENATED OILS (DAO) | | | | | | | | | |
|---|---|---|---|---|---|---|---|---|---|
| | PITCH TYPE | | | | | | | | |
| | SCT-PITCH (CP15) | | | COAL TAR PITCH | | | PETROLEUM PITCH | | |
| | TOTAL PITCH | ASPHAL-TENE | DAO | TOTAL PITCH | ASPHAL-TENE | DAO | TOTAL PITCH | ASPHAL-TENE | DAO |
| FRACTION (WT. %) | 100 | 68.0 | 32.0 | 100 | 77.0 | 23.0 | 100 | 70.0 | 30.0 |
| COKING VALUE @ 550° C. (WT. %) | 54.0 | 76.5 | 12.0 | 59.7 | 75.0 | 10.7 | 54.0 | 68.5 | 17.8 |
| BENZENE INSOLUBLES (WT. %) | 29.1 | 48.0 | 0.04 | 39.0 | 56.0 | 0.01 | 6.0 | 10.0 | 0.01 |
| AROMATIC CARBON (ATOM %) | 78 | 76 | 74 | 92 | 91 | 90 | 82 | 81 | 78 |
| CARBON/HYDROGEN ATOMIC RATIO | 1.38 | 1.42 | 1.16 | 1.60 | 1.69 | 1.45 | 1.40 | 1.39 | 1.21 |
| COKING VALUE @ 550° C. (%) CONTRIBUTED BY FRACTION | — | 51.7 | 3.8 | — | 57.7 | 2.5 | — | 47.9 | 5.3 |
| BENZENE INSOLUBLES (%) CONTRIBUTED BY FRACTION | — | 32.6 | NIL | — | 43.1 | NIL | — | 7.0 | NIL |

The two parts of the heavy residue have varying aromatic ring distribution. The oil fraction is composed of 2, 3, 4, 5 and 6 polycondensed aromatic rings. The asphaltene fraction is composed of 7 or more polycondensed aromatic rings.

The asphaltenes present in aromatic pitch have higher coking and molecular weights as illustrated in Table 4:

TABLE 4

MOLECULAR WEIGHT DISTRIBUTION OF SCT-PITCH, PETROLEUM PITCHES AND THEIR ASPHALTENES

| | MOLECULAR FRACTION | | | |
|---|---|---|---|---|
| | SCT-PITCH | | PETROLEUM PITCH | |
| MOL. WT. | PITCH | ASPHAL-TENE | PITCH | ASPHAL-TENE |
| 190 | 5.4 | 3.3 | 8.4 | 4.8 |
| 220 | 7.4 | 4.8 | 10.9 | 6.0 |
| 260 | 10.0 | 6.5 | 12.4 | 6.7 |
| 300 | 12.5 | 8.6 | 12.1 | 7.6 |
| 350 | 12.8 | 10.4 | 10.9 | 8.4 |
| 430 | 10.7 | 10.8 | 8.2 | 8.8 |
| 500 | 9.6 | 11.4 | 7.3 | 9.4 |
| 600 | 8.9 | 11.9 | 6.1 | 9.6 |
| 720 | 7.2 | 10.9 | 4.9 | 9.0 |
| 890 | 4.5 | 7.5 | 3.7 | 7.5 |
| 1060 | 2.8 | 4.8 | 2.8 | 6.1 |
| 1290 | 1.7 | 3.0 | 2.0 | 4.6 |
| 1560 | 0.9 | 1.7 | 1.3 | 3.2 |
| 1920 | 0.4 | 0.8 | 0.7 | 1.9 |
| 2400 | 0.2 | 0.3 | 0.4 | 1.0 |
| No. Ave. Mol. Wt. | 444 | 635 | 463 | 563 |
| Calculated Peak Ave. Mol. Wt. | 560 | 845 | 544 | 660 |

The use of heavy residues containing oil and asphaltene fractions is not desirable for mesophase pitch production. The presence of the two components in the feed which vary significantly in their chemical, thermal, coking and molecular weight makes it difficult to define process conditions suitable for the polymerization-/aromatic ring condensation of both the oil and the asphaltene parts of the feed. To overcome this problem, the heavy residue fraction has been treated to remove the asphaltene fraction by means of a distillation or a solvent deasphaltenation and the resulting asphaltene free fraction is thereafter employed. For example, in Application U.S. Ser. No. 291,990 (filed Aug. 11, 1981 and assigned to a common assignee), a process is described for heat soaking a deasphaltenated cat cracker bottom.

The separated asphaltene fraction constitutes a waste product and it would be desirable to be able to convert the asphaltene into a carbon artifact. It has recently been reported that a coal derived asphaltene, a waste obtained when coal is converted into liquid fuel, can be used to manufacture a carbon fiber composite (citation).

The present invention uses asphaltene feedstock fractions to provide a pitch which can be converted into a carbon artifact. The aromatic asphaltene fractions, because of their high molecular weight and high coking tendency, must be processed under specific certain conditions. If they are not so processed, the asphaltene will be converted into isotropic coke which is not useful for fabrication into anisotropic carbon products.

SUMMARY OF THE INVENTION

The present invention relates to a pitch suitable for carbon artifact manufacture and the manner in which it is produced. More particularly, the invention relates to a pitch which is suitable for carbon artifact manufacture which is obtained by heat soaking an asphaltene fraction of a feedstock at a temperature of about 380°–440° C. for about 1–500 minutes. The heat soaking can be effected at atmospheric pressure, under vacuum and at elevated pressure and, if desired, the resulting pitch can be vacuum stripped to remove unreacted oils.

It is an object of this invention to provide a new pitch suitable for use in carbon artifact manufacture derived from asphaltene.

It is another object of this invention to produce pitches with satisfactory softening and viscosity characteristics so that they can be formed into various carbon products.

These and other objects of the invention will be better understood and will become more apparent with reference to the following detailed description considered in conjunction with the accompanying drawings.

DETAILED DESCRIPTION OF THE INVENTION

Figure 1:
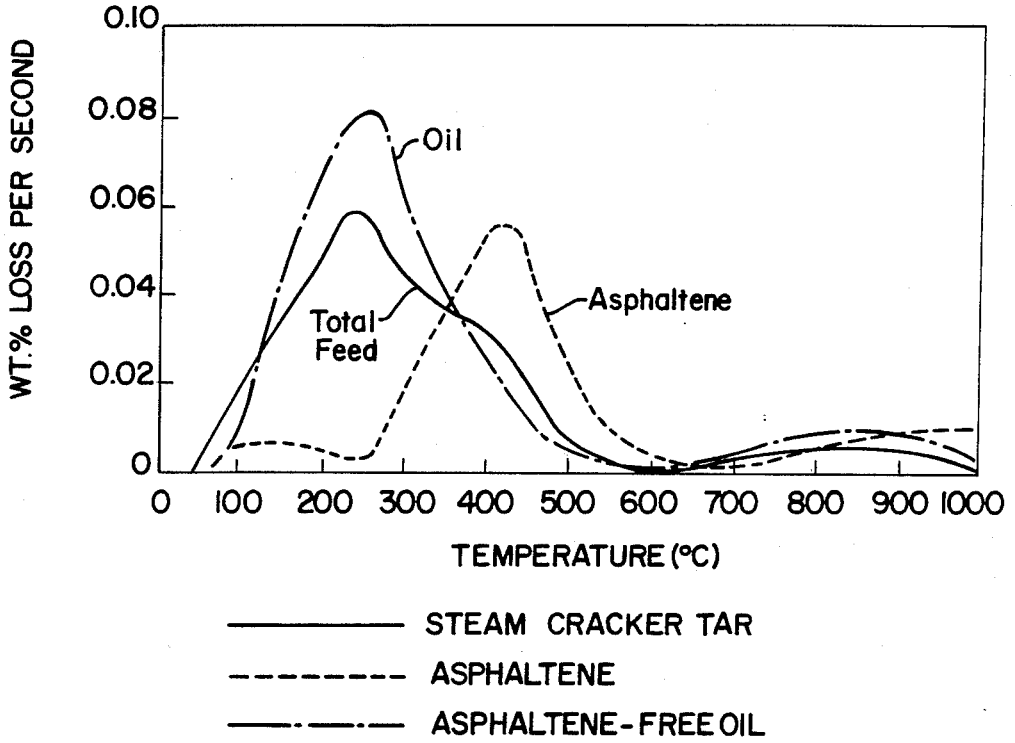
FIG. 1 illustrates a differential thermogravimetric analysis of a steam cracker tar and its asphaltene and asphaltene-free oil fractions.
Figure 2:
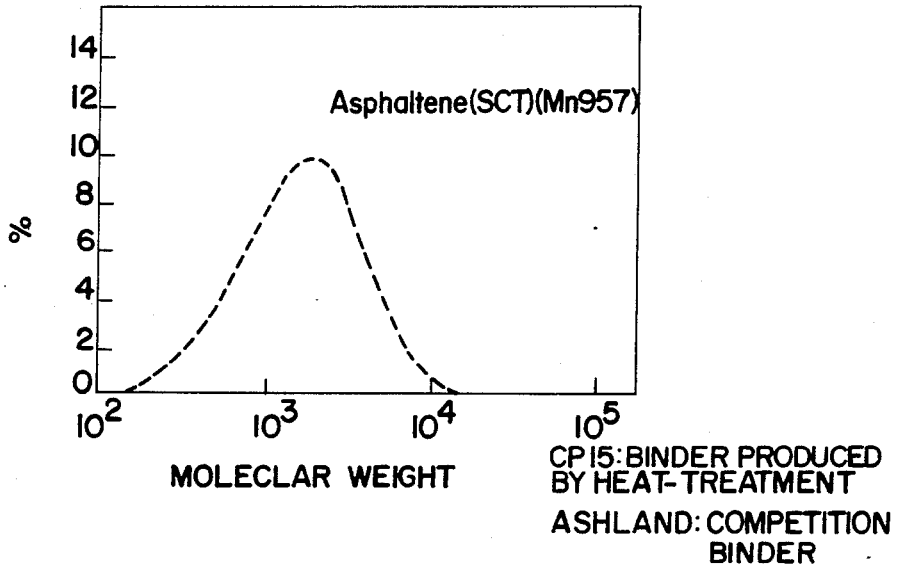
FIG. 2 illustrates the molecular weight distribution of asphaltenes present in a petroleum binder.

The asphaltene fraction employed in the present invention can be obtained from any suitable heavy aromatic feedstock. Such feedstocks include the catalytic cracker bottom obtained from the catalytic cracking of petroleum distillate, the steam cracker tar produced by the steam cracking of naphtha and gas oil and the coal tars from coal carbonization, liquefaction or gasification. The asphaltene fraction can be separated from these feedstocks as a result of its high boiling temperature and insolubility in paraffin solvents such as n-heptane. For example, the low molecular weight oil fraction of the feedstock can be removed by distillation and any residual low molecular weight oil can be removed by mixing the residue with n-heptane.

The asphaltene fraction must be heat soaked at an appropriate temperature and for an appropriate amount of time in order to convert the fraction into a pitch suitable for carbon artifact manufacture. If the temperature and time conditions are not proper, the asphaltene will be converted into isotropic coke which is not useful for fabrication into anisotropic carbon products and the pitch will not have the appropriate softening and viscosity characteristics so that it can be formed into various carbon products. The asphaltene fraction is heat soaked at temperatures in the approximate range of 380° to 440° C. for a period of time which can range from about 1 to 500 minutes. In the practice of the invention, it is particularly preferred that the heat soaking be conducted in a non-oxidizing atmosphere such as a nitrogen or a hydrogen atmosphere. The optimum combination of temperature and time varies depending on the particular asphaltene fraction employed but can readily be determined.

The heat soaking can be carried out at atmospheric pressure, under vacuum conditions or at elevated pressure. When vacuum is employed, the reduced pressure can be about 1 to 300 mm of mercury. When elevated pressure is used, it is preferably 50 to 500 psig.

When the heat soaking is complete, the reaction mixture can be subjected to vacuum stripping or steam stripping, if desired, to remove from the mixture at least a part of the unreacted fraction. Preferably, all of the unreacted fraction is removed in order to concentrate and increase the anisotropic liquid crystal fraction in the final pitch product. Optionally, the heat spoked mixture can be purged with a gas such as nitrogen in order to accelerate the removal of the unreacted fraction.

In order to further illustrate the present invention, various non-limiting examples are set forth hereafter.

EXAMPLE 1

ASPHALTENE FRACTION FROM A CATALYTIC CRACKING RESIDUE

A cat cracker bottom having the following characteristics was obtained:

| |
|---|
| Physical Characteristics |
| Viscosity cst at 120° F. = 10.0 |
| Ash content, wt. % = 0.050 |
| Coking value (wt. % at 550° C.) = 8.0 |
| Asphaltene (n-heptane insolubles), % = 1.0 |
| Toluene insolubles (0.35 u), % = 0.100 |
| Number average mol. wt. = 285 |
| Elemental Analysis |
| Carbon, % = 90.32 |
| Hydrogen, % = 7.40 |
| Oxygen, % = 0.10 |
| Sulfur, % = 2.0 |
| Chemical Analysis (by proton NMR) |
| Aromatic Carbon (atom %) = 65 |
| Carbon/hydrogen atomic ratio = 1.01 |
| Asphaltene analysis (n-heptane insolubles) |
| Number average mol. wt. % (GPC) = 650 |
| Coking value (at 550° C.), % = 44.0 |
| Bureau of mines correlation index = 120 (BMCI) |

The cat cracking bottom was charged into a reactor which was electrically heated and equipped with a mechanical agitator. The cat cracker bottom was then distilled and the following fractions were collected.

| FRACTION NO. | FRACTION BOILING RANGE (°C./760 mm Hg) | WEIGHT % |
|---|---|---|
| 1 | 271–400 | 10.6 |
| 2 | 400–427 | 25.9 |
| 3 | 427–454 | 9.2 |
| 4 | 454–471 | 11.3 |
| 5 | 471–488 | 12.4 |
| 6 | 488–510 | 11.3 |
| 7 | 510+ | 19.1 |

One thousand grams of the vacuum stripped residue was mixed with 20,000 grams of n-heptane in a large vessel equipped with an agitator and a condensor. The mixture was heated to reflux with agitation for one hour and then allowed to cool under a nitrogen atmosphere. The asphaltene was then separated by filtration using a Buckner filter/Whatman filter paper No. 40. The filtrate which contained the solvent and the asphaltene-free cat cracker residue was then vacuum stripped to remove the heptane. The yield of the asphaltene fraction was 800 g.

EXAMPLE 2

PITCH PRODUCTION BY ATMOSPHERIC HEAT-SOAKING/VACUUM STRIPPING

The asphaltene obtained in Example 1 was heat-soaked at atmospheric pressure under a nitrogen atmosphere at 400° C. for 4 hours with agitation. When the heat-soaked step was complete, the heat-soaked mixture was subjected to a reduced pressure of 1–5 mm of mercury to distill off the unreacted distillate. The maximum temperature during the stripping step was 400° C. The resulting pitch had 50% toluene insolubles, 23% pyridine insolubles and 12.2% quinoline insolubles.

EXAMPLE 3

ASPHALTENE PREPARATION FROM STEAM CRACKER TAR

The steam cracker tar having the following characteristics was treated by the method described in Example 1 to separate the asphaltene fraction:

| | SCT from Gas Oil Cracking | |
|---|---|---|
| | EX(1) | EX(2) |
| Physical characteristics | | |
| Viscosity cst @ 210° F. | 19.3 | 12.4 |
| Coking Value @ 550° F. | 16 | 24 |
| Toluene Insolubles (%) | 0.200 | 0.250 |
| n-Heptane Insolubles (%) | 16 | 20 |
| Pour Point (°C.) | +5 | −6 |
| Ash (%) | 0.003 | 0.003 |
| Chemical Structure (by Carbon and Proton NMR) | | |
| Aromatic Carbon (atom %) | 72 | 71 |
| Aromatic Protons (%) | 42 | 42 |
| Benzylic Protons (%) | 44 | 46 |
| Paraffinic Protons (%) | 14 | 12 |
| Carbon/Hydrogen Atomic Ratio | 1.011 | 1.079 |
| Elemental Analysis | | |
| Carbon (wt. %) | 90.31 | 88.10 |
| Hydrogen (wt. %) | 7.57 | 6.80 |
| Nitrogen (wt. %) | 0.10 | 0.15 |
| Oxygen (wt. %) | 0.22 | 0.18 |
| Sulfur (wt. %) | 1.5 | 4.0 |
| Iron (ppm) | 0.003 | — |
| Vanadium (ppm) | 0.001 | — |
| Silicon (ppm) | 0.00 | — |
| Number Average Molecular Wt. | 300 | 305 |
| Distillation Characteristics | | |
| 5% Vol | 283 | 245 |
| 10% Vol | 296 | 260 |
| 20% Vol | 330 | 296 |
| 30% Vol | 373 | 358 |
| 40% Vol | 421 | 371 |
| 50% Vol | 470 | 401 |
| 60% Vol | 540 | — |
| 70% Vol | 601 | — |
| 77% Vol | 610 | — |

The asphaltene was solvent extracted from the steam cracker tar from refluxing with n-heptane for 1 hour at a tar: solvent ratio of 1:30, and then the mixture was filtered using Whatman paper No. 42. The asphaltene was then washed and dried at 50° C. under reduced pressure.

EXAMPLES 4, 5, 6

PITCH PRODUCTION BY ATMOSPHERIC HEAT-SOAKING OF ASPHALTENE OF STEAM CRACKER TAR

The asphaltene obtained in Example 3 (2) was divided into three portions and heat-soaked in a glass reactor equipped with an agitator under a nitrogen atmosphere. The oils produced during the reaction were distilled off during the heat-soaking step. The pitches were cooled and analyzed and the results are shown in Table 4:

TABLE 4

| EXAMPLE | Feed | 4 | 5 | 6 |
|---|---|---|---|---|
| Heat-Soak Conditions | | | | |
| Time (min) | — | 20 | 5 | 20 |
| Temp (°C.) | — | 430 | 390 | 230 |

TABLE 4-continued

| EXAMPLE | Feed | 4 | 5 | 6 |
|---|---|---|---|---|
| Pitch Characteristics | | | | |
| Soft Point (R & B) °C. | 180 | 250 | 195 | 165 |
| Toluene Insolubles (Reflux %) | 0.1 | 78.0 | 50.0 | 22.0 |
| Benzene Insolubles (Reflux %) | 0.1 | 61 | 26.0 | 14 |
| Coking Value @ 550° C. (%) | 45.0 | 72.0 | 67.9 | 58.0 |
| Carbon/Hydrogen Ratio | 1.20 | 1.51 | 1.49 | 1.47 |

EXAMPLE 7

ASPHALTENE PREPARATION FROM PETROLEUM PITCH

A petroleum pitch (Ashland 240) having the following characteristics:

| | |
|---|---|
| Softening Point (°C.) | 112 |
| Coking Value @ 550° C. (%) | 55 |
| Ash (%) | 0.100 |
| Viscosity (cst) @ 160° C. | 1000-2000 |
| Toluene Insolubles Reflux (%) | 5.0 |
| Pyridine Insolubles Reflux (%) | 1.3 |
| Quinoline Insolubles (ASTM) % | 0.10 |
| Aromatic Carbon (Atom %) | 84 |
| C/H Atomic Ratio | 1.40 |
| Aliphatic Protons (%) | 12 |
| Benzylic Protons (%) | 37 |
| Aromatic Protons | 51 |
| Number Average Mol. Wt. | 450 |

was subjected to the extraction process with n-heptane described in Example 1 to separate the asphaltene from the pitch in a 68% yield.

EXAMPLES 8, 9 and 10

PITCH PRODUCTION BY VACUUM HEAT-SOAKING OF ASPHALTENE EXTRACTED FROM ASHLAND PITCH 240

The Ashland pitch 240 asphaltene obtained in Example 7 was divided into three portions and heat-soaked under reduced pressure with agitation. When the heating was complete, the resulting pitch was cooled under nitrogen and discharged. The heat-soaking conditions and the resulting pitch characteristics are set forth in Table 5:

TABLE 5

| Example | 8 | 9 | 10 |
|---|---|---|---|
| Heat-Soaking Conditions | | | |
| Time (hrs) | 1.0 | 2.0 | 1.0 |
| Temp (°C.) | 420 | 420 | 430 |
| Pressure (mm Hg abs.) | 100 | 100 | 100 |
| Pitch Characteristics | | | |
| Glass Transition Temp. (°C.) | 149 | 185 | 188 |
| Pyridine Insolubles (Reflux) (%) | 22.0 | 57.0 | 50.0 |
| Quinoline Insolubles (ASTM) (%) | 6.0 | 35.1 | 30.0 |
| Viscosity (poise) @ 350° C. | 22 | 109 | 78 |

Various changes and modifications can be made in the process and the products of this invention without departing from the spirit and scope thereof. The various embodiments which have been described herein were for the purpose of further illustrating the invention but were not intended to limit it.

What is claimed is:

1. A method of preparing a pitch suitable for carbon fibers manufacture consisting essentially of heat-soaking a feed material consisting of a heavy aromatic asphaltene fraction of a heavy aromatic cracked feedstock, said asphaltene fraction having a number average molecular weight of at least 900 and at least 7 polycondensed aromatic rings and is obtained from a petroleum distillate, naphtha or gas oil catalytic or steam cracking residues, at a temperature of about 380°-440° C. for about 1-500 minutes, and then subsequently removing unreacted oils from the heat soaked aromatic asphaltene fraction by vacuum distillation.

2. The method of claim 1 in which the heat-soaking is effected at atmospheric pressure.

3. The method of claim 1 in which the heat-soaking is effected under reduced pressure.

4. The method of claim 3 in which the reduced pressure is about 1-300 mmHg abs.

5. The method of claim 1 in which the heat-soaking is effected at elevated pressure.

6. The method of claim 1 in which the asphaltene fraction has a number average molecular weight of at least 900 and at least 7 polycondensed aromatic rings.

7. The method of claim 1 in which the heat-soaking is at a 390°-420° C. for 5-240 minutes.

8. The method of claim 1 in which a heavy aromatic feedstock is treated so as to separate the asphaltene fraction therefrom.

* * * * *